US012220651B2

(12) United States Patent
Bly et al.

(10) Patent No.: US 12,220,651 B2
(45) Date of Patent: Feb. 11, 2025

(54) ENVIRONMENTALLY FRIENDLY LIGHTWEIGHT KNOCKDOWN BUILDING BLOCK SET

(71) Applicant: Big Level, LLC., Kane, PA (US)

(72) Inventors: Richard Bly, Kane, PA (US); Andrew Bly, Forest Hills, NY (US); Danielle Montalto-Bly, Forest Hills, NY (US); Joanne Bly, Kane, PA (US)

(73) Assignee: BIG LEVEL, LLC., Kane, PA (US)

( * ) Notice: Subject to any disclaimer, the term of this patent is extended or adjusted under 35 U.S.C. 154(b) by 226 days.

(21) Appl. No.: 17/873,006

(22) Filed: Jul. 25, 2022

(65) Prior Publication Data

US 2023/0025275 A1 Jan. 26, 2023

Related U.S. Application Data

(60) Provisional application No. 63/224,916, filed on Jul. 23, 2021.

(51) Int. Cl.
*A63H 33/08* (2006.01)
*A63H 33/04* (2006.01)

(52) U.S. Cl.
CPC ..... *A63H 33/084* (2013.01); *A63H 33/044* (2013.01); *A63H 33/08* (2013.01)

(58) Field of Classification Search
CPC ..... A63H 33/06; A63H 33/08; A63H 33/084
See application file for complete search history.

(56) References Cited

U.S. PATENT DOCUMENTS

| | | | |
|---|---|---|---|
| 1,562,006 | A | 11/1925 | Sichterman |
| 1,604,391 | A | 10/1926 | Croy |
| 2,278,327 | A | 3/1942 | Magnus et al. |
| 2,751,705 | A | 6/1956 | Joseph |
| 2,874,512 | A | 2/1959 | Joseph et al. |

(Continued)

OTHER PUBLICATIONS

Caldera YM, Culp AM, O'Brien M, Truglio RT, Alvarez M, and Huston AC. 1999. Children's Play Preferences, Construction Play with Blocks, and Visual-spatial Skills: Are they Related? International Journal of Behavioral Development; 23 (4): 855-872.

(Continued)

*Primary Examiner* — John A Ricci
(74) *Attorney, Agent, or Firm* — Blynn L. Shideler; Krisanne Shideler; BLK Law Group

(57) ABSTRACT

An environmentally friendly knockdown building block set includes a cardboard shipping box; a plurality of main cardboard blanks each configured to form a base block including four connecting slots therein as wide as the base block thickness; a plurality of coupling cardboard blanks each configured to form an H-block including two connecting slots therein with each slot located between two legs of the H-block and as wide as the H-block thickness; wherein the connecting slots of each base black and each H-block allow for receipt and interconnection of the base block or H-block with an associated base block or H-block forming a notched connection for the base blocks and H-blocks; wherein at least the main blocks include an inking pattern using plant based environmentally friendly inks; and wherein the shipping box is an integral component configured to be integrated into structures formed by the set.

18 Claims, 3 Drawing Sheets

(56) References Cited

U.S. PATENT DOCUMENTS

| | | | | |
|---|---|---|---|---|
| 4,708,691 | A * | 11/1987 | Moore | A63H 33/044 446/106 |
| 5,167,704 | A * | 12/1992 | Brower | C09D 167/08 106/31.74 |
| 5,281,181 | A | 1/1994 | Mccollum | |
| 5,281,185 | A | 1/1994 | Lee | |
| 5,895,045 | A | 4/1999 | Vilar | |
| 9,327,206 | B2 * | 5/2016 | Donohoe | A63H 33/08 |
| 10,296,185 | B2 * | 5/2019 | Chang | G06F 3/04842 |
| 2015/0038246 | A1 * | 2/2015 | Zeid | A63H 33/084 472/136 |
| 2016/0296850 | A1 * | 10/2016 | Scaccia | A63B 63/00 |
| 2018/0229143 | A1 * | 8/2018 | Morales | A63H 33/008 |
| 2019/0076730 | A1 * | 3/2019 | McManus | A63H 33/06 |

OTHER PUBLICATIONS

Christakis DA, Zimmerman FJ, and Garrison MM. 2007. Effect of block play on language acquisition and attention in toddlers: a pilot randomized controlled trial. Abstract and Conclusion, Arch Pediatr Adolesc Med. 161 (10):967-71.

Ferrara K, Hirsch-Pasek K, Newcombe NS, Golinkoff RM and Shallcross Lam W. 2011. Block talk: Spatial language during block play. Mind, Brain, and Education (5): 143-151.

Legoff DB and Sherman M. 2006. Long-term outcome of social skills intervention based on interactive LEGO play. Autism. (4):317-29;10.

Newcombe NS, Levine SC, and Mix KS3. 2015. Thinking about quantity: the intertwined development of spatial and numerical cognition. Wiley Interdiscip Rev Cogn Sci. 6(6):491-505.

Oostermeijer M, Boonen JH and Jolles J. 2014. The relation between children's constructive play activities, spatial ability, and mathematical word problem-solving performance: a mediation analysis in sixth-grade students. Frontiers in Psychology 5 Article 782.

* cited by examiner

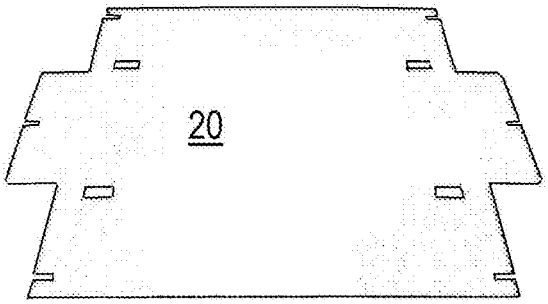
FIG. 2
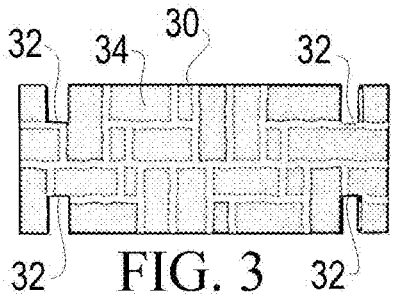
FIG. 3
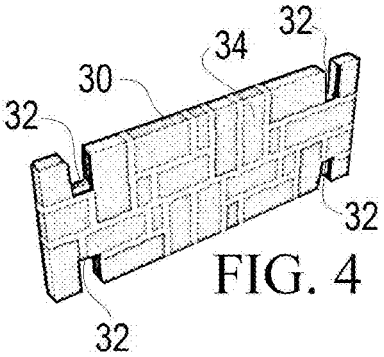
FIG. 4
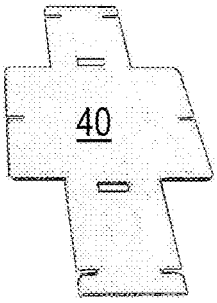
FIG. 5
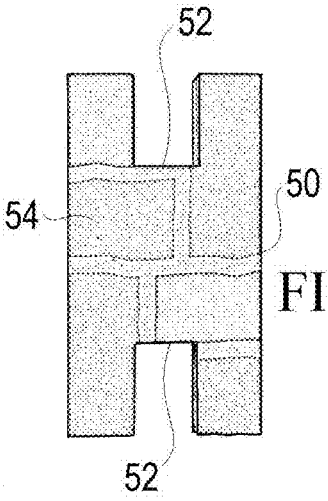
FIG. 6
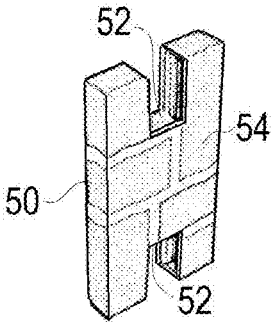
FIG. 7
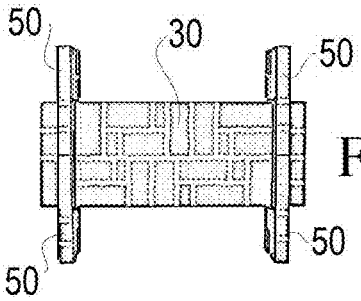
FIG. 8
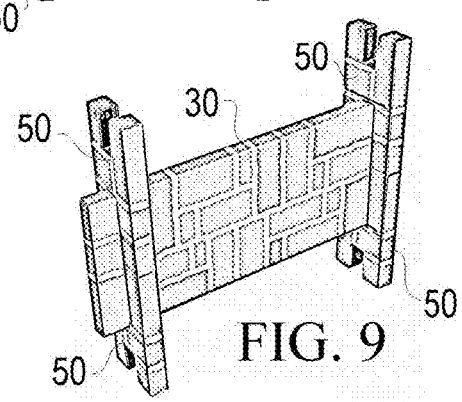
FIG. 9
FIG. 10
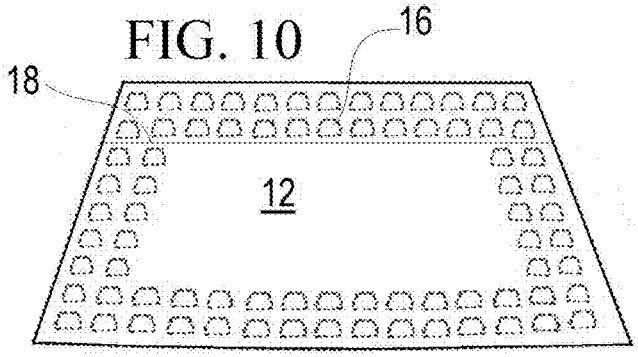

ENVIRONMENTALLY FRIENDLY LIGHTWEIGHT KNOCKDOWN BUILDING BLOCK SET

RELATED APPLICATIONS

The present application claims the benefit of U.S. Provisional Patent Application Ser. No. 63/224,916 filed Jul. 23, 2021 titled "Environmentally Friendly Lightweight Knockdown Building Block Set" which is incorporated herein by reference.

BACKGROUND OF THE INVENTION

1. Field of the Invention

This invention generally relates to building block sets, and in particular to environmentally friendly building block set.

2. Background Information

Building blocks, also called "toy blocks," are most broadly described as solid shapes used for construction play. Some are simple planks made of wood. Others are formed as interlocking units, such as a simulated plastic brick like the LEGO® or MEGABLOCK® brand toys. Whatever form they take, building blocks function as powerful learning tools. Studies suggest that toy blocks can help children develop motor skills and hand-eye coordination, spatial reasoning, cognitive flexibility, language skills, a capacity for creative and divergent thinking, social competence, and engineering skills. There is also evidence that complex block-play is linked with higher mathematical achievement. In support of these assertions see: 1) Caldera Y M, Culp A M, O'Brien M, Truglio R T, Alvarez M, and Huston A C. 1999. *Children's Play Preferences, Construction Play with Blocks, and Visual-spatial Skills: Are they Related*? International Journal of Behavioral Development; 23 (4): 855-872; 2) Casey B M, Andrews N, Schindler H, Kersh J E, Samper A and Copley J. 2008. *The development of spatial skills through interventions involving block building activities*. Cognition and Instruction (26): 269-309; 3) Christakis D A, Zimmerman F J, and Garrison M M. 2007. *Effect of block play on language acquisition and attention in toddlers: a pilot randomized controlled trial*. Arch Pediatr Adolesc Med. 161 (10): 967-71; 4) English L D, King D, and Smeed J. 2017. *Advancing integrated STEM learning through engineering design: Sixth-grade students' design and construction of earthquake resistant buildings*. Journal of Educational Research 110 (3): 255-271; 5) Heisner J. 2005. *Telling Stories with Blocks: Encouraging Language in the Block Center* Early Childhood Research and Practice 7 (2); 6) Ferrara K, Hirsch-Pasek K, Newcombe N S, Golinkoff R M and Shallcross Lam W. 2011. *Block talk: Spatial language during block play*. Mind, Brain, and Education (5): 143-151; 7) Jirout J J and Newcombe N S. 2015. *Building blocks for developing spatial skills: evidence from a large, representative U.S. sample*. Psychol Sci. 26 (3): 302-10; 8) Kamii C, Miyakawa Y and Kato Y. 2004. *The development of logico-mathematical knowledge in a block-building activity at ages* 1-4. Journal of Research in Childhood19: 44-57; 9) Legoff D B and Sherman M. 2006. *Long-term outcome of social skills intervention based on interactive LEGO play*. Autism. 10 (4): 317-29; 10) Newcombe N S, Levine S C, and Mix KS3. 2015. *Thinking about quantity: the intertwined development of spatial and numerical cognition*. Wiley Interdiscip Rev Cogn Sci. 6 (6): 491-505; 11) Oostermeijer M, Boonen J H and Jolles J. 2014. *The relation between children's constructive play activities, spatial ability, and mathematical word problem-solving performance: a mediation analysis in sixth-grade students*. Frontiers in Psychology 5 Article 782; 12) Schmitt S A, Korucu I, Napoli A R, Bryant L M, Purpura D J. 2018. *Using block play to enhance preschool children's mathematics and executive functioning: A randomized controlled trial*. Early Childhood Research Quarterly 44:181-191; 13) Verdine B N, Golinkoff R M, Hirsh-Pasek K, Newcombe N S, Filipowicz A T, Chang A. 2013. *Deconstructing Building Blocks: Preschoolers' Spatial Assembly Performance Relates to Early Mathematical Skills*. Child Dev. 2013 Sep. 23. doi: 10.1111/cdev.12165; 14) Wolfgang C H, Stannard L L, and Jones I. 2003. *Advanced constructional play with LEGOs among preschoolers as a predictor of later school achievement in mathematics*. Early Child Development and Care 173 (5): 467-475; and 15) Wolfgang, Charles H.; Stannard, Laura L.; & Jones, Ithel. 2001. *Block play performance among preschoolers as a predictor of later school achievement in mathematics*. Journal of Research in Childhood Education, 15 (2), 173-180.

The research consistently supports the conclusion that building block play is very beneficial for physical, emotional, social, and cognitive child development. Further, psychologists and education specialists generally agree that if a child learns new things through joyful, healthy play, then he/she develops love of learning more easily. The benefits of building block play being well understood and appreciated, a relatively large number of building block play sets have been developed.

For example, U.S. Pat. No. 1,562,006 discloses an educational building construction set using a series of interlocking male and female blocks. U.S. Pat. No. 2,278,327 similarly teaches an educational building construction set using a series of interlocking blocks. U.S. Pat. No. 5,281,181 teaches an educational building construction set using a series of interlocking blocks, that may also described as planks. U.S. Pat. No. 5,895,045 teaches a modular building set using "modular plastic cards." These patents are incorporated herein by reference.

Building block sets in which the individual blocks are formed from a single sheet of material are also known. These are sometimes called knockdown structures, or folded blank structures. The term "knockdown" herein references structures that can be formed from planar or blank components. U.S. Pat. Nos. 1,604,391; 2,751,705; 2,874,512; and 5,281,185 teach various knockdown building block sets. The above identified patents are incorporated herein by reference in their entireties.

Several years ago the word "sustainability" was not in most people's vocabulary. Times changed. Today "sustainability" is on many people's minds. It is a subject that has moved to the forefront of our society and industry. It is certainly never too early to teach children to be good stewards of the environment. Plastic toys, even if educational, are detrimental to the environment. Plastic pollution is well known to cause harm to humans, animals and plants through toxic pollutants. It can take hundreds or even thousands of years for plastic to break down so the environmental damage is long-lasting. Plastic affects all organisms in the food chain from tiny species like plankton through to whales. Toxins work their way up the food chain when plastic is ingested and can even be present in the fish people eat. The toys we utilize to educate our youths should not be contributing to this pollution, further the proper selection of renewable resources in forming toys can enhance the educational opportunities of the associated toy by giving an opportunity to discuss the materials used and the associated effect on the environment.

There remains a need for making environmentally friendly knockdown building block sets that remain easy and fun to use.

SUMMARY OF THE INVENTION

The present invention is an environmentally friendly knockdown building block sets that remain easy and fun to use. One aspect of the present invention provides an environmentally friendly knockdown building block set comprising: a cardboard shipping box; a plurality of main cardboard blanks within the shipping box, each main blank configured to form a three dimensional base block of the environmentally friendly knockdown building block set which base block includes four connecting slots therein that are as wide as the thickness of the base block; a plurality of coupling cardboard blanks within the shipping box, each coupling blank configured to form a three dimensional H-block of the environmentally friendly knockdown building block set which H-block includes two connecting slots therein with each slot located between two legs of the H-block and as wide as the thickness of the H-block; wherein the connecting slots of each base black and each H-block allow for receipt of, and interconnection of, the base block or H-block with a connecting slot of an associated base block or with a slot of an associated H-block forming a notched connection for the base blocks and H-blocks of the environmentally friendly knockdown building block set; wherein at least the main blocks include an inking pattern using plant based environmentally friendly inks; and wherein the cardboard shipping box is an integral component of the play set and configured to be integrated into structures formed by the base blocks and the H-blocks of the set.

These and other advantages of the present invention will be clarified in the following description taken together with the following figures in which like reference numerals represent like elements throughout.

BRIEF DESCRIPTION OF THE FIGURES

FIG. 2 is a perspective view of a blank for forming a main block of the environmentally friendly knockdown building block set of FIGS. 1A, 1B and 1C.

FIG. 3 is an elevation side view of the assembled blank of FIG. 2 forming the main block with a representative inking pattern.

FIG. 4 is a perspective view of the assembled blank of FIG. 2 forming the main block with a representative inking pattern.

FIG. 5 is a perspective view of a blank for forming a connecting block of the environmentally friendly knockdown building block set of FIGS. 1A, 1B and 1C.

FIG. 6 is an elevation side view of the assembled blank of FIG. 5 forming the connecting block with a representative inking pattern.

FIG. 7 is a perspective view of the assembled blank of FIG. 5 forming the connecting block with a representative inking pattern FIG. 8 is a side elevation view of a construction using a main block and four connecting blocks using the environmentally friendly knockdown building block set according to the present invention.

FIG. 9 is a perspective view of the construction of FIG. 8.

FIG. 10 is a schematic plan view of the shipping box panel member of the environmentally friendly knockdown building block set shown in FIG. 1 according to the present invention.

DESCRIPTION OF THE PREFERRED EMBODIMENTS

Environmentally Friendly Substrates

Figure 1A:
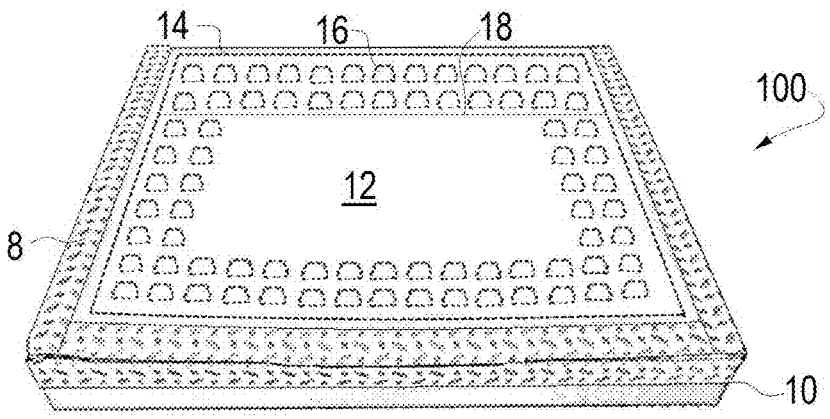
FIGS. 1A-C are perspective views of an environmentally friendly knockdown building block set according to the present invention without inking and in a shipping configuration.

The present invention provides an environmentally friendly knockdown building block sets 100 that remain easy and fun to use. The one important aspect of the present invention is that each of the components (box 10 and blanks 20 and 40) of the set 100 is formed from a planar blank of cardboard, preferably recycled cardboard.

Cardboard is easy to recycle and can be reused as new paper products, of various types, generally from five to seven times before the fibers become too short to use. One ton of recycled cardboard has been calculated to save 17 mature trees. Further the recycling of cardboard saves water. The pulping process uses a lot of water to break down the bulk structure of the wood's fiber source (bark, chips, stems, etc.) to make paper or cardboard. Recycling one ton of cardboard has been calculated to save 7,000 gallons of water during the pulping process.

Recycled cardboard cuts down on CO2 emissions in several ways. The trees saved through recycling would absorb significant carbon dioxide from the air each year, and, alternatively, if harvested would emit CO2 back into the environment. Further manufacturing cardboard from virgin trees in a forest takes more energy than it does to manufacture cardboard from recycled products.

The recycling process saves landfill space. Even though cardboard is biodegradable and recyclable, compared to organic material (leaves, food scraps, etc.) it takes much longer to break down, generally more than one year for full remediation. Cardboard recycling benefits the environment many times over, and the components of the present invention are formed from recycled cardboard components.

Adhesives

The one important aspect of the present invention is that each of the components, namely box 10 and blanks 20 and 40, of the set 100 is formed adhesive free. The phrase "adhesive free" in the component formation, excludes the blank manufacturing process and shipping process. Water pollution can be a problem with dispersion adhesives (emulsion adhesive). Waste from the solvent adhesive is not easily biodegradable. In the manufacturing industry, it can be eliminated along with excess sludge by biodegradable treatment plants. If solvents contaminate water, however, it can lead to the destruction of wildlife and possible contamination of drinking water. When liquid adhesive residues are not disposed of utilizing proper hazardous waste collection, they may end up contaminating the soil and eventually the groundwater. This can lead to the destruction of flora and fauna and dangerous health risks for anyone who comes into contact with it. There are solvent free adhesives that are certainly better for the environment, and if an adhesive would be required then a solvent free adhesive would be preferred over a conventional solvent based adhesive, however the preferred implementation of the present invention does not utilize any adhesive.

The blank manufacturing process may include binders and/or adhesives in the formation of the blanks 20 and 40. The preferred blank manufacturing process according to the present invention uses starch based glues in the cardboard formation, namely those derives from natural carbohydrates such as derived from roots, tubers and seeds of higher plants such as maize, potatoes, wheat, rice and tapioca.

With environmental concerns even small items can add up to a significant difference over time. The sealing tape 8 shown in FIG. 1A of the packaging box 10 of the set 100 of present invention is environmentally friendly. Preferably 100% plant based sealing tape is used such as CELLO Carton Sealing Tape, KRAFT Flatback Tape, or water activated KRAFT paper tape from Eco-enclose.

Base Block 30

Figure 1B:
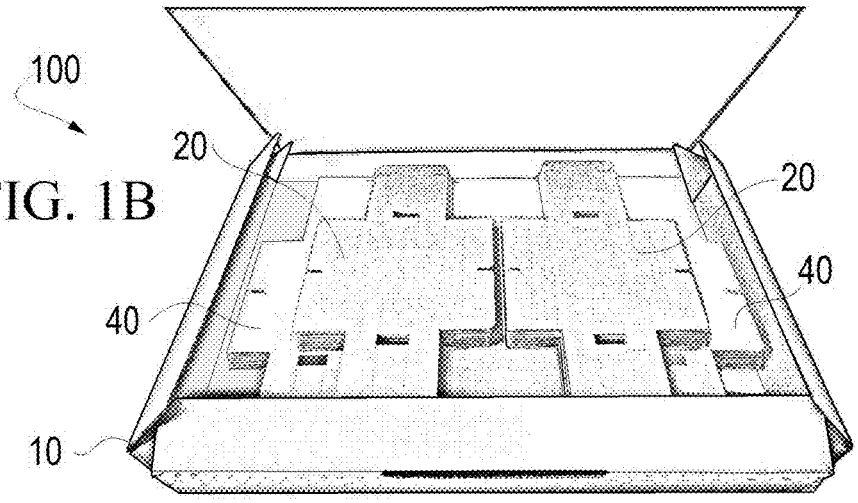
Figure 1C:
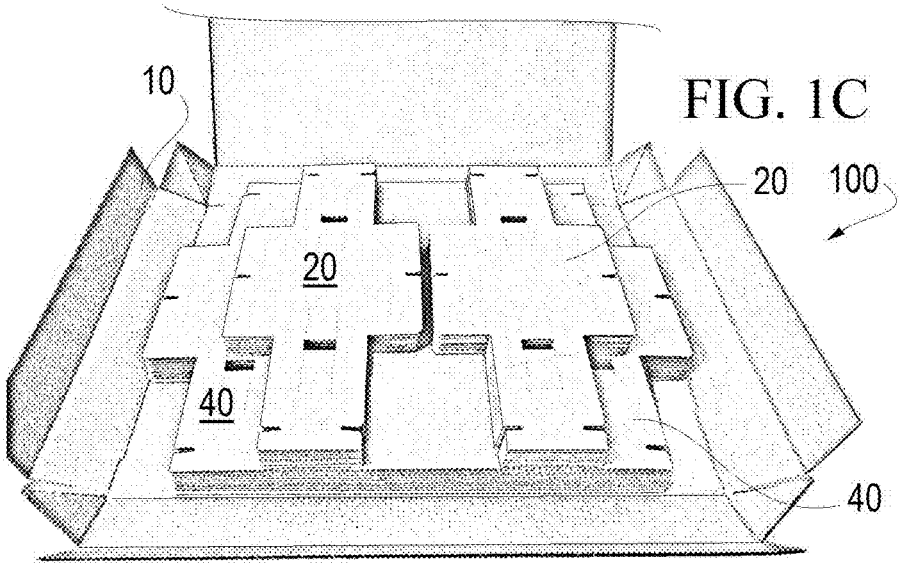

FIG. 2 is a perspective view of a blank 20 for forming a main block 30 also called the base block 30 of the environmentally friendly knockdown building block set 100 of FIGS. 1A, 1B and 1C. FIG. 3 is an elevation side view of the assembled blank 20 of FIG. 2 forming the main block 30 or base block 30 with a representative inking pattern 34 discussed below. FIG. 4 is a perspective view of the base block 30. The set 100 will include 6 to 18 base block blanks 20, preferably 8-12 and more preferably 10 in a single set 100.

The base block 30 is formed with four connecting slots 32 or grooves therein as shown that are as wide as the thickness of the block 30 to allow for receipt of, and interconnection of, the base block 30 with a connecting slot 32 of an associated base block 30 or with a slot 52 of a connecting block 50 of FIGS. 5-7. The connecting slot design formed by slots 32 and 52, sometimes called interconnecting slots, inter-engaging slots, notched connection, or similar terms, is easy to understand, use and implement by young children. See for example the Toy Cabin Construction of U.S. Pat. No. 1,351,086 made famous under the brand name LINCOLN LOGS®. It is worth noting that in 1999 the LINCOLN LOGS® toy and its inventor John Lloyd Wright were entered into the National Toy Hall of Fame and it has been credited to "be the first toy to be marketed to both boys and girls and appeal to a 'simple' type of creativity." This is believed to, in part, be because of the ease of use and understanding by the child users of the notched connection and its ability to yield a resulting sturdy connection. These factors help unleash the child's creativity. The building set 100 of the present invention is built upon this foundation as well by implementing a notched connection.

Connecting Block 50

FIG. 5 is a perspective view of a blank 40 for forming a connecting block 50 also called an H-block 50 of the environmentally friendly knockdown building block set 100 of FIGS. 1A, 1B and 1C. FIG. 6 is an elevation side view of the assembled blank 40 of FIG. 5 forming the connecting block 50 or H-block 50 with a representative inking pattern 54 discussed below. FIG. 7 is a perspective view of the H-block 50. The set 100 will generally include twice as many connecting blocks 50 as base blocks 30, namely 12-36 connecting block blanks 40, preferably 16-24 and more preferably 20 in a single set 100.

The connecting block 50 is formed with two opposed connecting slots 52 or grooves therein as shown that are as wide as the thickness of the block 50 to allow for receipt of and interconnection of the connecting block 50 with a slot 32 of an associated base block 30 or with a slot 52 of an associated connecting block 50 using the inter-engaging slots or notches. FIGS. 8-9 show a representative sample of a construction using a main block 30 and four connecting blocks 50 using the environmentally friendly knockdown building block set 100 according to the present invention.

Shipping or Packaging Blocks or Panel Members 12

The packaging of many products yields an excessive amount of waste. An important aspect of the present invention is that the shipping package or packaging box 10 will form an integral part or component of the play set 100 of the invention as shown in FIG. 10.

The fact that a shipping container 10 may be used, often by itself, as an imaginative toy by children is certainly well known to the parents, whom often see children imaginatively playing with the box that a gift comes in, making many exclaim that they should have just purchased the box. However, the present invention has the shipping packaging or box 10 become an integral component of the play set 10. The first method is having the shipping package 10 form, generally one or preferably two, panel members 12 that can be integrated into the play set. The panel members 12 may be considered as panel block members in the block set, but unlike the base block 30 and the H-blocks 50 they are not hollow structures. The panel members 12 may include perforated outline 14 to allow for separation of the panel member 12 from the remainder of the box 10 and may further include perforations 16 to form openings to receive, generally the "legs" of the H-blocks 50 (the legs being the portion of the block 50 on either side of the slot 52), there through to interconnect or secure the panel member 12 to construction in any of several configurations.

The panel member 12 preferably includes at least one living hinge 18, whereby if the panel member 12 (once removed from the remainder of the box 14 along perforations 14) is only coupled to a construction along one side the living hinge 18 allows the remaining portion of the panel member 12 to assume a vertical orientation (e.g. it folds along the living hinge 18 that is generally horizontal). FIG. 10 is a schematic plan view of the shipping box panel member 12 of the environmentally friendly knockdown building block set 10 shown in FIG. 1 having a living hinge 18 and the perforations 16 for openings to couple to the legs.

In the vertical orientation the remaining portion of the panel member 12 may form a hanging panel, or a pivoting door. For example, where the panel member 12 is located on the ground, the remaining portions may be pivoted up about the aligning hinge 18 to form a simulated castle drawbridge. In this "drawbridge" arrangement, the space from coupling to the other blocks 50 to the living hinge 18 will allow the "drawbridge" to slightly lean against the construction (slightly beyond vertical) in an "over center" position so that it can stay upright as desired, and it should be understood that gravity is would likewise be sufficient to also maintain the drawbridge in the open position when pivoted down.

Where the panel member 12 is supported by blocks 50 on opposed sides of the living hinge 18 then it can form an elevated platform (elevated floor for a simulated $2^{nd}$ or $3^{rd}$ floor of a tower or other structure) in a construction. The panel member 12 can of course merely be placed on the ground and the construction build on top with the inking pattern of the panel member 12 adding color or flavor to the construction, however it is the selective vertical orientations and or elevated floors that are believed to add true integration of the panel block member 12 with the remaining elements of the set 100.

Figure 11:
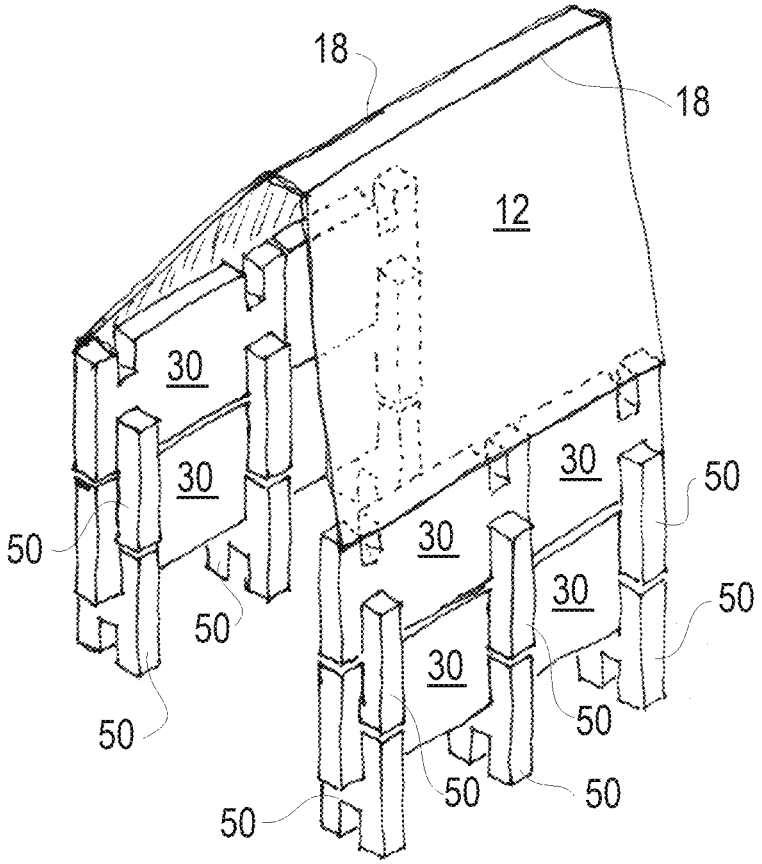
FIG. 11 is a schematic perspective view of an alternative shipping box panel member of the environmentally friendly knockdown building block set according to the present invention incorporated into a building structure thereof.

FIG. 11 is a schematic perspective view of an alternative shipping box panel member 12 of the environmentally friendly knockdown building block set 100 according to the present invention incorporated into a building structure thereof. Here two living hinges 18 are present and these may be the same as used in the assembly of the box 10. Here the panel member is designed to form roof type structure, but the specific uses are left to the user's imagination.

The inking pattern on the panel members 12 can be the same as inking patterns 34 and 54 on the other blocks 30 and 50, but in light of the intended uses it may have a more complementary pattern appropriate for the varied horizontal and vertical implementations in the constructions. Regardless the inking pattern for the panel member 12 will utilize the same environmentally friendly inks as the remaining blocks 30 and 50 and preferably at least some of the cardboard color will be used as an accent or portion of the design.

As an alternative to the panel members 12 the shipping package or box 10 may form an integral part of the play set of the invention by being formed into one or preferably two hollow "specialty" blocks with inter-engaging slots/grooves (which slots are shown in the blocks above). The box 10 formed blocks would be specialty blocks in that only one or two of such blocks are provided with each set. Examples of such specialty blocks would be in the shape of the main block with a central opening there through for a simulated "window". It is possible the packaging is formed into one panel member (that can form a simulated drawbridge or door)) and one specialty block that forms a simulated window. Although there are several variation, it is important that the shipping packaging 10 form an integral component (or components) of the set 100 to further minimize waste.

Environmentally Friendly Inking

Printing inks play a role in "sustainability". The present invention uses green or sustainable water flexographic inks for the patterns 34 and 54 (and anything on the packaging box 10 or panel members 12) and improve the sustainability of the present invention set. The main raw materials used in water-based flexographic inks are pigment, water, vehicle and additives. The patterns 34 and 54 are shown as brick and mortar or stone and mortar (collectively a brick/stone and mortar pattern) with the natural cardboard color used to form one of the brick/stone or motor to provide greater environmental benefits through saving ink.

Standard water-based flexographic ink vehicle systems are based on acrylic and/or styrenated acrylic resins and emulsions derived from one source only, petroleum. Petroleum is not a renewable but rather is a depleting resource.

Two raw materials from renewable resources are making inroads into water-based flexographic inks. These are green and sustainable raw materials. The first group includes polymers derived from soy beans and the second group includes rosin derivatives from pine trees. The main advantage of soy- and rosin-based inks versus conventional acrylic-based inks is that they are derived from renewable resources and as such they are green and sustainable.

The chemicals in pine trees include rosin (resin acids such as abietic, pimaric, levopimaric, etc.), fatty acids (stearic, oleic, linoleic) and turpentine. There are three types of rosin produced by pine trees, i.e., gum, wood and tall oil rosin. Gum rosin is collected from live pine trees. Wood rosin comes from the dried stumps of pine trees. Tall oil rosin is obtained after distillation of crude tall oil from the black liquor of the Kraft paper making process. Black liquor is quite toxic and, in the old days, it was discharged into rivers and lakes, thus creating environmental havoc by polluting the waterways. This discharge of black liquor is no longer practiced. It is now collected, reprocessed and through distillation yields tall oil rosin. The rosin is then esterified to produce rosin esters of maleic, phenolic, fumaric and other acids. These modified rosin esters have acid numbers ranging between 100 and 250.

As with acrylic and styrenated acrylic resins, the rosin esters can be dissolved in water with ammonium hydroxide, sodium hydroxide and/or amines. The rosin ester solution can then be used alone or in combination with acrylic resin solutions and emulsions to produce water-based flexographic inks and varnishes of excellent quality. Generally, it is not necessary or advisable to replace all the acrylic vehicles in the ink with rosin ester vehicles. A good beginning is to replace about 50% of the acrylic resin solution with rosin ester solution.

A line of water-based flexographic inks has been developed through the use of rosin ester technology. In no case were they inferior to the conventional acrylic-based inks. For instance, pigment loading was reduced in many cases, press speeds have increased by about 25%, thus increasing through put, driers on the press could run at 75% capacity instead of 100%, thus, saving energy, bronzing and ghosting were practically eliminated while ink transfer, adhesion, coverage, wet traps and heat resistance improved noticeably. Other properties, such as gloss, viscosity and pH stability, resolubility/rewetting, water resistance, plate and anilox roll wash-up performed at the same levels as the conventional acrylic inks. No detrimental effects have been observed.

Water-based flexographic inks, by their nature, are the most environmentally and ecologically friendly printing inks in use to-day. In order to comply with environmental requirements all water-based flexographic inks, whether conventional acrylic- or soy- or rosin ester-based, should not use any environmental banned substances, no Volatile Organic Compounds, no Hazardous Air Pollutants and no Heavy Metals. To be truly environmentally green, in addition to being sustainable by using renewable pine rosin esters, these inks do not contain any heavy metals, such as the so called CONEG (Coalition of Northeastern Governors) metals which include lead, cadmium, mercury and hexavalent chromium.

In addition to minimizing heavy metals in the inks used in the present invention, preferably the set 100 of the present invention provides that that the sum of incidental concentration levels of lead, cadmium, mercury and hexavalent chromium present in any component does not exceed 100 ppm (parts per million) by weight. Furthermore, in cases where the regulated metals are present below the limit stated above (100 ppm), these regulated metals were not intentionally added during the manufacturing process.

Other environmental banned substances that are absent from the inks used in the set 100 of the present invention, and preferably in the remaining components as a whole of the present invention, include: 1) Chlorinated Organic Compounds-Polychlorinated Biphenyls (PCBs), 2) Brominated Organic Compounds-Polybrominated Biphenyls (PBBs) and Polybrominated Diphenyl Ether (PBDE), 3) Asbestos, 4) Formaldehyde, and 5) Polyvinyl Chloride (PVC).

The four CONEG metals, along with Polybrominated Biphenyls (PBBs) and Polybrominated Diphenyl ether (PBDE) are banned by the RoHS, Restriction of Hazardous Substances Directive, which was adopted by the European Union in 2003. Both the inks and the components are free from these six materials within compliance with the RoHS.

Volatile Organic Compounds (VOCs) are those organic compounds which participate in atmospheric photochemical reactions having ozone forming potential. With a few exceptions, all organic compounds of carbon are included as VOCs. The presence of VOCs is substantially reduced in water flexographic inks as compared to solvent inks. In certain instances VOCs can be reduced to zero. Formulations can be developed whereby ingredients are free of VOCs, therefore, the ink is VOC free. If at all possible, VOCs can be easily and substantially reduced if the formulator does not use additives or ingredients such as low molecular weight alcohols, glycols, glycol ethers and amines. The new line of sustainable rosin ester-based inks has very little to no VOCs. Generally, they contain less than 1% VOCs.

Hazardous Air Pollutants (HAPs) is another group of chemical compounds that have detrimental effects on the environment. The list of HAPs contains about 200 chemicals including methanol, methyl isobutyl ketone, diethanol amine, triethylamine and certain glycol ethers such as the mono- and di-ethers of ethylene, diethylene and triethylene glycol. Most water-based flexographic inks can be formulated so that they are free of HAPs. The new rosin ester water flexographic inks do not contain any HAPs at all. Thus the inks used in the present invention and the component sof the present invention are preferably substantially free of HAPs.

The European Chemicals Agency (ECHA) has published a Candidate List of 15 Substances of Very High Concern (SVHC) which are either toxic and/or mutagenic and/or carcinogenic. The SVHC Candidate list includes compounds such as anthracene, dibutyl phthalate, cobalt dichloride, sodium dichromate, etc. Water flexographic inks, in general, do not contain any of these 15 toxic, mutagenic or carcinogenic Substances of Very High Concern. The rosin ester inks, in particular, have absolutely no SVHCs in their formulations or in their constituent raw materials. The Canadian Department of the Environment, Canadian Environmental Protection Act of 1999, lists 14 chemicals that are hazardous to health and to the environment. Some of the compounds on the list include Pigment Yellow 60, Pigment Brown 22, Isophorone, Michler's ketone, and Dioxane. Water-based flexographic inks do not generally contain any of these banned chemicals, and rosin ester inks, definitely, have none of these in their formulations.

Use of green, sustainable, environmentally friendly and ecologically compatible water-based flexographic inks, especially eco-friendly inks from renewable pine rosin esters, may result in energy conservation and a reduced carbon footprint. Replacement of petroleum-based acrylic resins and emulsions with rosin esters will result in a lower carbon footprint. Although exact figures cannot be obtained at this time, it is estimated that about three gallons of oil, used to make acrylics derived from petroleum, can be saved per 55-gallon drum of ink, by replacing acrylics with rosin esters. Again, as an estimate, this represents a savings of approximately 60 pounds of carbon dioxide per one drum of ink, or about six pounds of carbon dioxide per one five-gallon pail of ink.

The new water-based flexographic inks discussed herein have been shown to be green, sustainable and environmentally and ecologically friendly products. These inks are formulated with rosin esters which are derived from renewable pine tree tall oil rosin. The rosin esters replace petroleum-based acrylic resins, thus, preserving petroleum resources, even at very small amounts. The rosin ester inks were shown to have properties equal to or, in certain cases, better than conventional acrylic inks, they are free or contain very low VOCs, they are free of HAPs, they are free of heavy metals and other environmental banned substances (CONEG, TPCH, Sony Standard and RoHS), they are free of any of the 15 Substances of Very High Concern of the European Chemicals Agency List, and they are free of any of the 14 hazardous substances listed in the Canadian Environmental Protection Act.

The building set 100 of the present invention preferably uses green, sustainable, environmentally friendly and ecologically compatible water-based flexographic inks as discussed above, although these may also be referenced slightly more broadly as plant based environmentally friendly inks. Further each block 30 or 50 or panel member 12 preferably has some of underlying cardboard color showing as part of the pattern 34 or 54 to further support an ecologically friendly overall design.

The broader classification of plant based inks, sometimes called botanical inks, are, as a whole, less harmful to the environment than their petroleum-based counterparts. Soy and vegetable products may be used in ink for their oils, which act as the vehicle for the ink pigments. There are also several types of vegetable-based printing inks, including linseed (Flax), tung (Chinawood), castor, canola, and safflower. FLAT STORAGE It is obvious that the blocks 30 and 50 of the set 100 of the present invention are shipped flat to the user and assembled on-site. Further the process can be reversed for extremely compact storage of the set 100 in the form of flat blanks 20 and 40 (and flat panel members 12), such as in preparation for a move or where an older sibling has outgrown the set and a younger sibling, or expected younger future sibling, is some time away from using the set 100. However, even the assembled blocks 30 and 50 can be stored in a somewhat planar orientation in a somewhat compact orientation without complete disassembly of the blocks 30 and 50 to return them to the blank 20 and 40 configuration. This flat storage in fact can be a critical part of the educational aspects of the building set 100 for the child. There is certainly studies on the advantages of instilling the discipline of putting one's toys away, however the flat planar storage of the assembled blocks 30 and 50 of the set offers a little more than this discipline alone. There is learning, and some creativity, in compactly stacking the block set 100 of the invention, and it is another aspect of the invention that all the blocks 30 and 50 maintain this flat aspect for storage. In other words the blocks 30 and 50 of the invention do not include coupling members or the like that would prevent this storage configuration.

While this invention has been particularly shown and described with references to the preferred embodiments thereof, it will be understood by those skilled in the art that various changes in form and details may be made therein without departing from the scope of the invention.

What is claimed is:

1. An environmentally friendly knockdown building block set comprising:

A cardboard shipping box;

A plurality of main cardboard blanks within the shipping box, each main blank configured to form a three dimensional base block of the environmentally friendly knockdown building block set which base block includes four connecting slots therein that are as wide as the thickness of the base block;

A plurality of coupling cardboard blanks within the shipping box, each coupling blank configured to form a three dimensional H-block of the environmentally friendly knockdown building block set which H-block includes two connecting slots therein with each slot located between two legs of the H-block and as wide as the thickness of the H-block;

Wherein the connecting slots of each base black and each H-block allow for receipt of, and interconnection of, the base block or H-block with a connecting slot of an associated base block or with a slot of an associated H-block forming a notched connection for the base blocks and H-blocks of the environmentally friendly knockdown building block set;

Wherein at least the base blocks include an inking pattern using plant based environmentally friendly inks;

Wherein the cardboard shipping box is an integral component of the play set and configured to be integrated into structures formed by the base blocks and the H-blocks of the set; and Wherein the box includes at least one panel block members, and wherein each panel member includes a perforated outline to allow for separation of the panel member from the remainder of the box.

2. The environmentally friendly knockdown building block set according to claim 1, wherein the cardboard of the main cardboard blanks and the coupling cardboard blanks is recycled cardboard.

3. The environmentally friendly knockdown building block set according to claim 1, wherein the base blocks and the H-blocks are formed adhesive free.

4. The environmentally friendly knockdown building block set according to claim 1, wherein the cardboard shipping box includes plant based sealing tape.

5. The environmentally friendly knockdown building block set according to claim 1, wherein each base block includes a brick/stone and mortar inking pattern.

6. The environmentally friendly knockdown building block set according to claim 5, wherein the inking pattern of each base block utilizes the natural cardboard color to form one of the brick/stone or mortar.

7. The environmentally friendly knockdown building block set according to claim 1, wherein the set includes 6 to 18 base block blanks.

8. The environmentally friendly knockdown building block set according to claim 1, wherein each H-block includes a brick/stone and mortar inking pattern using plant based environmentally friendly ink.

9. The environmentally friendly knockdown building block set according to claim 1, wherein the inking pattern of each H-block utilizes the natural cardboard color to form one of the brick/stone or mortar.

10. The environmentally friendly knockdown building block set according to claim 1, wherein the set includes 12 to 36 coupling block blanks.

11. The environmentally friendly knockdown building block set according to claim 1, wherein the set includes twice as many coupling block blanks and base block blanks.

12. An environmentally friendly knockdown building block set according to claim 1 comprising:

A cardboard shipping box;

A plurality of main cardboard blanks within the shipping box, each main blank configured to form a three dimensional base block of the environmentally friendly knockdown building block set which base block includes four connecting slots therein that are as wide as the thickness of the base block;

A plurality of coupling cardboard blanks within the shipping box, each coupling blank configured to form a three dimensional H-block of the environmentally friendly knockdown building block set which H-block includes two connecting slots therein with each slot located between two legs of the H-block and as wide as the thickness of the H-block;

Wherein the connecting slots of each base black and each H-block allow for receipt of, and interconnection of, the base block or H-block with a connecting slot of an associated base block or with a slot of an associated H-block forming a notched connection for the base blocks and H-blocks of the environmentally friendly knockdown building block set;

Wherein at least the base blocks include an inking pattern using plant based environmentally friendly inks;

Wherein the cardboard shipping box is an integral component of the play set and configured to be integrated into structures formed by the base blocks and the H-blocks of the set; and Wherein the box includes at least one panel block members, and wherein each panel member includes perforations to form openings to receive the legs of the H-blocks.

13. The environmentally friendly knockdown building block set according to claim 1, wherein each panel member includes at least one living hinge.

14. An environmentally friendly knockdown building block set comprising:

A cardboard shipping box;

Six to eighteen main blanks within the shipping box formed of recycled cardboard, each main blank configured to form a three dimensional base block of the environmentally friendly knockdown building block set which base block includes four connecting slots therein that are as wide as the thickness of the base block;

Twelve to thirty-six coupling blanks within the shipping box formed of recycled cardboard, each coupling blank configured to form a three dimensional H-block of the environmentally friendly knockdown building block set which H-block includes two connecting slots therein with each slot located between two legs of the H-block and as wide as the thickness of the H-block;

Wherein the connecting slots of each base black and each H-block allow for receipt of, and interconnection of, the base block or H-block with a connecting slot of an associated base block or with a slot of an associated H-block forming a notched connection for the base blocks and H-blocks of the environmentally friendly knockdown building block set;

Wherein at least the base blocks and H-blocks include an inking pattern using plant based environmentally friendly inks; and Wherein the cardboard shipping box includes at least one panel block member configured to be an integral component of the play set and configured to be integrated into structures formed by the base blocks and the H-blocks of the set, and wherein each panel member includes perforations to form openings to receive the legs of the H-blocks.

15. The environmentally friendly knockdown building block set according to claim 14, wherein the set includes twice as many coupling block blanks and base block blanks.

16. The environmentally friendly knockdown building block set according to claim 14, wherein each H-block and each base block includes a brick/stone and mortar inking pattern using plant based environmentally friendly ink.

17. The environmentally friendly knockdown building block set according to claim 16, wherein the inking pattern of each H-block and base block utilizes the natural cardboard color to form one of the brick/stone or mortar.

18. The environmentally friendly knockdown building block set according to claim 17, wherein the base blocks and the H-blocks are formed adhesive free and wherein the cardboard shipping box includes plant based sealing tape.

* * * * *